United States Patent [19]

Harvey et al.

[11] Patent Number: 4,950,178

[45] Date of Patent: Aug. 21, 1990

[54] AC POWER INTERCONNECT FOR STACKED ELECTRONIC DEVICES

[75] Inventors: Robert T. Harvey, Wichita, Kans.; David C. White, Cincinnati, Ohio

[73] Assignee: NCR Corporation, Dayton, Ohio

[21] Appl. No.: 424,049

[22] Filed: Oct. 19, 1989

[51] Int. Cl.[5] ..... H01R 31/08

[52] U.S. Cl. ..... 439/507; 439/509; 439/247; 439/655; 439/460

[58] Field of Search ..... 439/507, 509–512, 439/514, 515, 247, 248, 460, 266, 694, 653, 654, 655

[56] References Cited

U.S. PATENT DOCUMENTS

| | | | |
|---|---|---|---|
| 2,676,223 | 4/1954 | Whitaker | 200/115.5 |
| 3,497,850 | 2/1970 | Gallo, Sr. | 337/197 |
| 3,533,053 | 10/1970 | Sosinski | 339/198 |
| 3,546,659 | 12/1970 | Powers | 339/91 |
| 3,649,953 | 3/1972 | Hoffman | 339/64 M |
| 3,806,767 | 4/1974 | Lehrfeld | 439/507 |
| 3,980,386 | 9/1976 | Spadoni, Jr. | 339/218 M |
| 4,047,786 | 9/1977 | Gietzen | 430/655 |
| 4,568,902 | 2/1986 | van Hoof et al. | 336/10 |
| 4,880,395 | 11/1989 | Eriksson et al. | 439/507 |

*Primary Examiner*—Paula A. Bradley

*Attorney, Agent, or Firm*—Wilbert Hawk, Jr.; Stephen F. Jewet; Jack R. Penrod

[57] ABSTRACT

A one piece jumper power cord molded out of rubber or some other insulating material. The one piece power cord conforms to the rear shape of a vertical stack of electronic devices that it interconnects. By keeping the power cords short and properly shaped, power can be jumpered from a lower device housed in a lower enclosure of the vertical stack to an upper device housed in an upper enclosure without a loose jumper cord dangling therebetween, wasting space and providing a possible hazard for passing objects or persons to catch on.

14 Claims, 4 Drawing Sheets

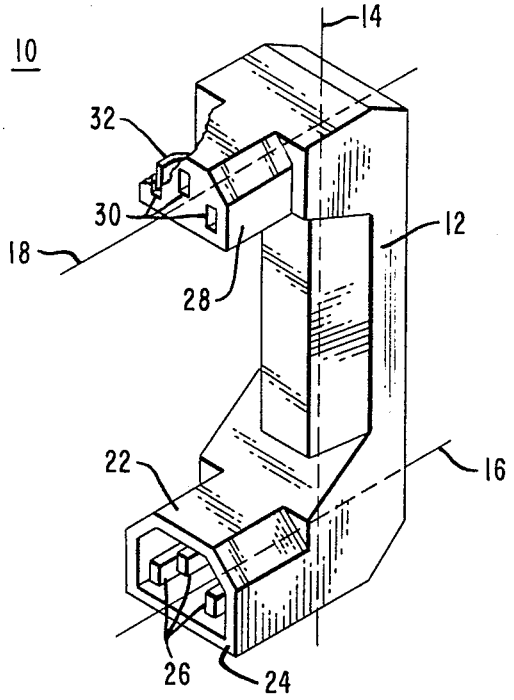
FIG. 1
FIG. 2
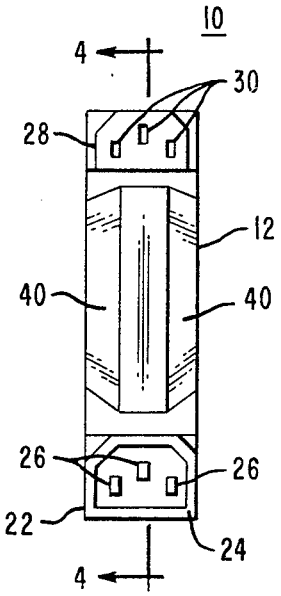
FIG. 3
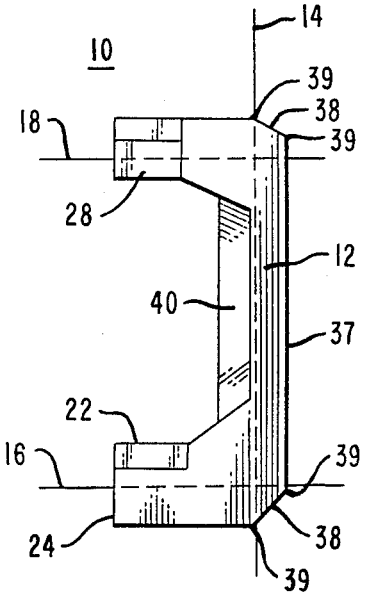

AC POWER INTERCONNECT FOR STACKED ELECTRONIC DEVICES

BACKGROUND OF THE INVENTION

The present invention relates to an electrical connector for electronic devices, and more particularly to a one piece molded electrical connector which interconnects electronic devices in a vertical stack.

Often power supplies, disk drives, tape drives, and similar electronic devices are housed in stackable enclosures. The stackable enclosures have bottom members which mate and interlock in some manner with top members of the next enclosure. Usually an interlock mechanism of some kind is provided so the enclosures may be securely mounted atop each other to form a vertical stack. Additional mating enclosures may be added in a similar manner to form a higher vertical stack.

It is standard practice in the art to provide each electronic device housed in a stackable enclosure with an AC power input and an AC power output. The AC power input receives AC power via electrical conductors from an external source, such as a wall outlet, to provide power for the electronic device. The AC power output, on the other hand, is provided for convenience and safety purposes. On most electronic devices, the AC power output is wired directly to the AC power input so that each lower electronic device may serve as a secondary source of AC power for the next higher electronic device of the vertical stack.

This type of arrangement has lead to the common practice of connecting a jumper cord between each lower AC power output of each lower device to a respective AC power input of a respective upper electronic device stacked immediately there above. This obviates the need for a bundle of AC power cords running to a set of external AC wall outlets and adds the convenience of single point ON/OFF switch if the operator so desires.

Unfortunately, the jumper cords used are always longer than necessary to jumper AC power between stacked devices. There are a number of reasons for this surplus of length of the AC power cords. The predominate reason is that off-the-shelf commercial AC power cords are used. The problem with using off-the-shelf commercial AC power cords is that even the shortest such cord is too long to simply jumper AC power between two stacked devices. The second most common reason is to provide flexibility; i.e., to provide the capability of interconnecting stacked devices or non-stacked devices. Such flexibility requires longer AC power cords than those necessary to simply jumper AC power vertically from a lower device to the next higher device. The problem with the flexible jumper power cords is that they result in a tangle of jumper power cords sticking out behind the stack of devices. This tangle of power cords is an eyesore, especially for devices which are located on a desk. Such a tangle is also a waste of valuable desk/bench space beyond the amount necessary to support the stacked devices. Furthermore, a tangle of overly long jumper power cords behind a stack of devices on a desk top increases the possibility that one of the cords will catch on a passing person or object, and possibly cause injury or damage.

It is therefore an object of this invention to provide a minimally short jumper AC power cord for two adjoining enclosures in a vertical stack which is sized to jumper an AC power output from a lower enclosure to an AC power input of an upper enclosure.

It is another object of this invention to provide a jumper AC power cord which is not easily caught by a passing person or object.

It is another object of this invention to provide a one-piece molded, jumper cord assembly.

SUMMARY OF THE INVENTION

According to one aspect of the invention, the foregoing objects are achieved by providing a device for electrically interconnecting two electronic devices. The electrically interconnecting device includes a first connector for making electrical contact with one of the electronic devices, a second connector for making electrical contact with another of the electronic devices, and a body member by which the first and second connectors are joined. Inside of the body member is a conductor which electrically connects the first connector to the second connector. The body member and the first and second connections of the electrically interconnecting device are integrated into a single rigid structure.

BRIEF DESCRIPTION OF THE DRAWINGS

While the specification concludes with the appended claims particularly pointing out and distinctly claiming the subject matter which is regarded as the invention, it is believed that the invention will be better understood from the following detailed description of the illustrative embodiment taken in conjunction with the accompanying drawings in which:

FIG. 1 is a perspective view of an AC power jumper device according to the present invention that is partially broken away to show interior details;

FIG. 2 is a front view of the AC power jumper device of FIG. 1;

FIG. 3 is a right side view of the AC power jumper device of FIG. 1;

DETAILED DESCRIPTION OF A PREFERRED EMBODIMENT

Figure 5:
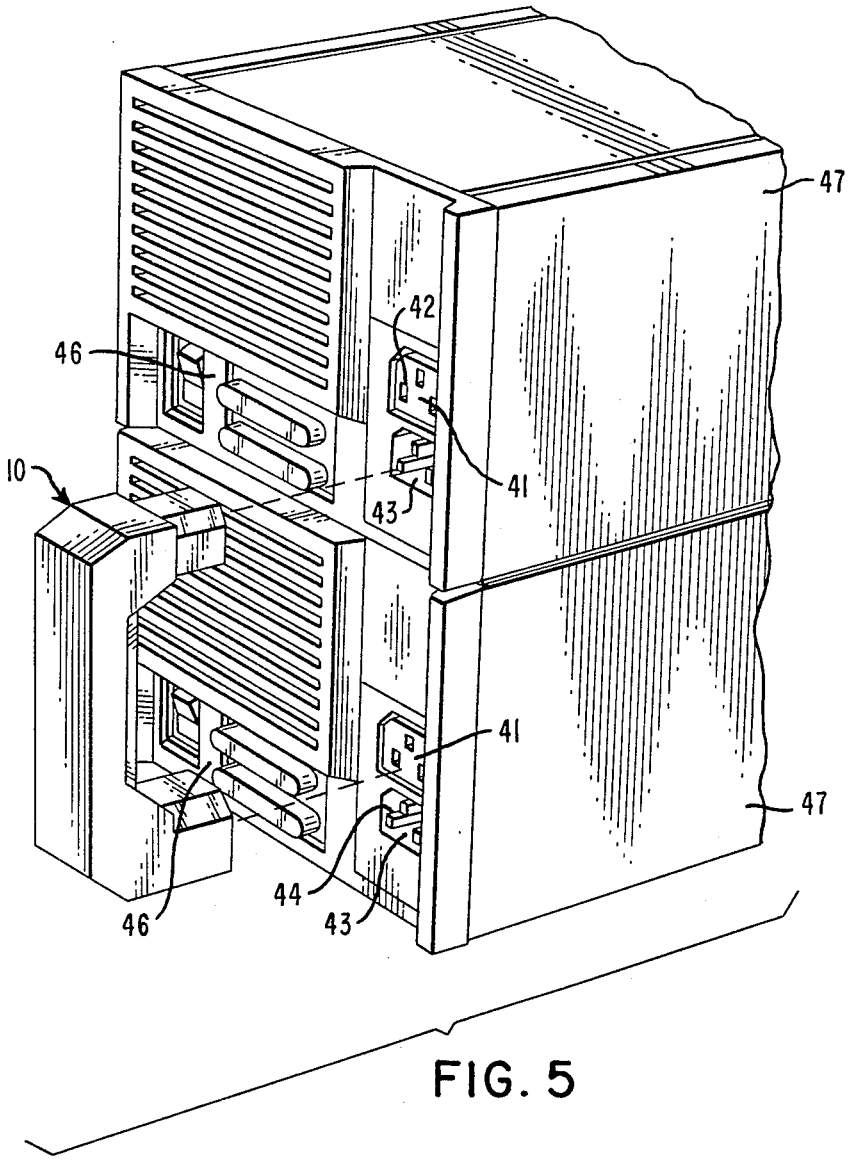
FIG. 5 is a partially broken away perspective view, illustrating how the jumper device connects between two stacked electronic devices.
Figure 6:
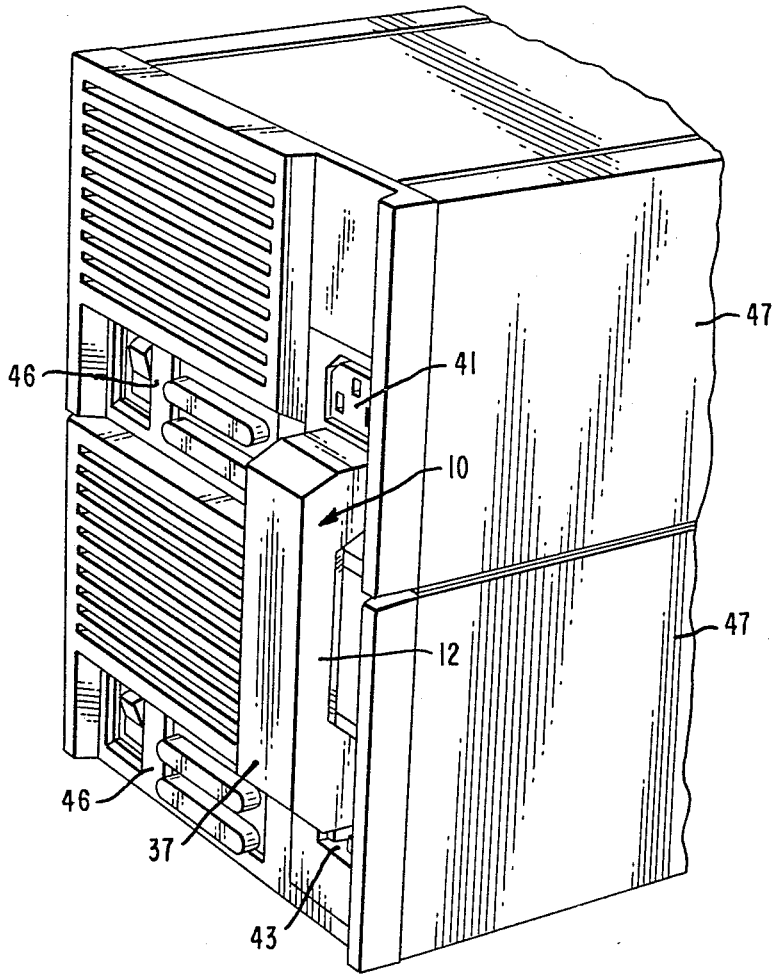
FIG. 6 is a partially broken away perspective view showing the jumper device after it is installed on the two stacked devices.

Referring to FIGS. 1, 2, and 3 there is shown a jumper device 10 in accordance with the present invention. The jumper device 10 is adapted to interconnect two of two or more electronic devices that are housed in respective enclosures as shown in FIGS. 5 and 6, and of a type described in copending U.S. patent application Ser. No. 423,928, filed Oct. 19, 1989 and entitled INTERLOCK ARRANGEMENT FOR STACKABLE ENCLOSURES. This co-pending application has the same inventors as the present application, and is commonly assigned to NCR Corporation. The co-pending application is designated as Ser. No. 423,928, and the disclosure thereof is hereby incorporated by reference.

The jumper device 10 has a body member 12 which has a vertical axis 14. The jumper device 10 terminates at one end with a female receptacle 22. The female receptacle 22 lies along a second axis 16 that is perpendicular to the axis 14.

The female receptacle 22 has a hexagonally shaped shell 24 that is made of an insulating material. Mounted within the hexagonally shaped shell 24 are three male electrical connectors 26. The hexagonally shaped shell 24 and the male electrical connectors 26 are shaped, arranged, and sized to cooperate with a panel mounted male fitting or connector 41 (see FIG. 5). The panel mounted male fitting 41 has three female connectors 42 (see FIG. 5). The shape and arrangement of the panel mounted male fitting 41 conforms to the International Electrotechnical Commission (IEC) power connector type 320. However, those skilled in the art will appreciate that the female receptacle 22, the male electrical connectors 26, the male fitting 41, and female connectors 42 (see FIG. 5) may have other shapes and electrical connector arrangements.

At another end, the jumper device 10 terminates in a male fitting 28. The male fitting 28 lies along a third axis 18. The axis 18 is also perpendicular to the axis 14.

The male fitting 28 has a hexagonal shape, and is made of an insulating material. The male fitting 28 has three openings 30 therein for mounting three female electrical connectors 32. The male fitting 28, the openings 30, and the female connectors 32 are shaped, arranged, and sized to cooperate with a panel mounted female receptacle or connector 43 that has three male connectors 44 (see FIG. 5), and which conforms to IEC power connector type 320. However, those skilled in the art will appreciate that the male fitting 28, the female connectors 32, the female receptacle 43 and the male connectors 44 (see FIG. 5) may have other shapes and connector arrangements.

The female receptacle 22 and the male fitting 28 are joined together by the body member 12. Since the female receptacle 22 and the male fitting 28 lie along the axes 16 and 18, which are perpendicular to the axis 14 of the body member 12, it follows that the female receptacle 22 and the male fitting 28 joined to and extend from the body member 12 at right angles.

The body member 12 is preferably formed of an insulating material such as a rubber or some type of thermoplastic material, although almost any insulating material may be used. Preferably, the body member 12, the female receptacle 22, and the male fitting 28 are integrally formed into a single piece by a molding process. The molding process used is well known and does not constitute part of the present invention.

As can be seen in FIGS. 1, 2, 3, and 4, the female receptacle 22 and the male fitting 28 face in the same direction. Their axes 16 and 18 are not only perpendicular to the vertical axis 14, but the axes 16, 18 also lie in a common plane with the vertical axis 12 as they extend from the body member 12 in the same direction. The distance that the female receptacle 22 extends from the body member 12 is kept as small as possible, and yet is sufficiently long to make good electrical connections with its mating connector. The distance that the male fitting 28 extends from the body member 12 is similarly kept as small as possible. By keeping these distances as small as possible, the distance that the body member 12 extends beyond the mating connectors is kept small when the jumper device 10 is installed, thereby reducing the likelihood that the body member 12 will catch on a passing person or object.

In addition to reducing the likelihood of catching on a passing person or object by keeping the amount that the body member 12 extends from its mating connectors low, the likelihood of the body member 12 catching on a passing person or object is further reduced by the shape of the body member 12. As shown in FIG. 3, the body member 12 has a flat back surface 37 that is substantially, parallel to the rear panels of the enclosures 47 when the device 10 is installed (shown in FIG. 6). Sharp, right angle corners are reduced by providing bevel surfaces 38 that convert the possible right angle transitions from the back surface 37 to the female receptacle 22 and the male fitting 28 to transitions with more gradual corners 9.

Front bevels 40 are molded in the body member 12 in order to provide finger grips for installation and removal of the jumper device 10, but these finger grips are on the front or inside of the jumper device 10 and thus do not provide surfaces which would catch a passing person or object.

Figure 4:
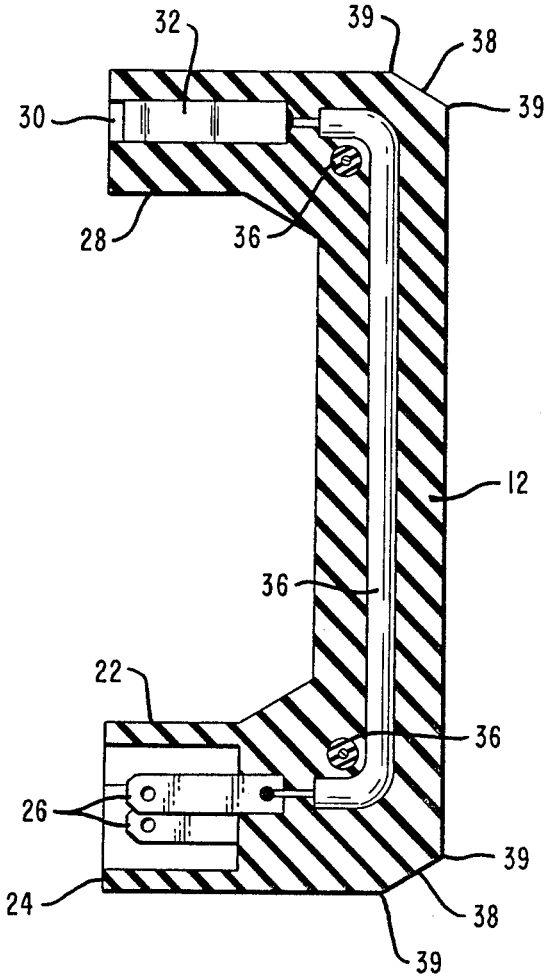
FIG. 4 is a cross sectional view of the AC power jumper device taken along line 4—4 shown in FIG. 2.

Referring now to FIG. 4, which is a cross sectional view of the jumper device 10, further details of the three male connectors 26 and the three female connectors 32 are illustrated. Each male connector 26 and female connector 32 is physically held in position by a portion of the body member 12. Additionally, each male connector 26 is electrically connected to a respective female connector 32 by an electrical conductor 36. In FIG. 4, the molded insulating material of the body member 12 is cut away to illustrate the center male connector 26 connecting to the center female connector 32. Also illustrated in FIG. 4 are cross sections of the other two electrical conductors 36 which must cross over or under the center electrical conductor 36 that is described immediately above. These two conductors 36 cross the center conductor 36 in order to maintain the same standard connection configuration as an off-the-shelf jumper cord would have. The adherence to the standard configuration is for the purposes of safety and interchangeability. The need to cross the electrical conductors 36, which connect the two outer male connectors 26 to their respective outer female connectors 32, would be obviated by the known method of rotating either the panel mounted female receptacle 43 or the panel mounted male fitting 41 one half circle, i.e. 180 degrees, from the orientation shown in FIG. 5. This would mean that the center connector on the male fitting 41 would be located at the top of the three connectors 42 (as shown in FIG. 5) and the center connector on the female receptacle 43 would be located at the bottom of its three connectors 44 (opposite to that shown in FIG. 5), or that the center connector on the male fitting 41 would be located at the bottom of its three connectors 42 (opposite to that shown in FIG. 5) and the center connector on the female receptacle 43 would be located at the top of its three connectors 44 (as shown in FIG. 5).

The dashed lines in FIG. 5 illustrate how the jumper device 10 interconnects with the male fitting 41 of a lower one of two electronic devices 46 housed in vertically stacked enclosures 47 and the female receptacle 43 of the upper, one of the electronic devices 46 in its enclosure 47. The vertically stacked enclosures 47 physically interlock with each other as described in the aforementioned co-pending patent application entitled INTERLOCK ARRANGEMENT FOR STACKABLE ENCLOSURES. This means that the lower enclosure 47 is always in the same relative position with respect to the upper enclosure 47, thereby providing a predetermined vertical distance that the jumper device 10 must traverse.

The power connectors 41, 43 are selected for connection with AC power according to a standard safety practice. Male connectors, because they may be inadvertently touched by a passing person are only used as AC power entry connections In this manner, a male connector is non-electrified unless it is shielded from inadvertent contact by a mating female connector. A female connector, because it is recess mounted, may be electrified without fear of being inadvertently touched by a passing person. Thus, each female receptacles 43 with three male connectors 44 provides an entry point for AC power into its electronic device 46. Furthermore, each male fitting 41 with three female connectors 42 may be an electrified connection point from which AC power may be jumpered to a higher electronic device 46.

Referring now to FIG. 6, the jumper device 10 is installed in its operating position connecting power from a lower electronic device 46 housed in irs enclosure 47 to a similar upper electronic device 46 housed in its upper enclosure 47. The body member 12 of the jumper device 10 physically connects to the female receptacle 24 and the male fitting 28 (not shown in FIG. 6) at right angles..such that the back surface 37 lies in parallel with the rear panel of the electronic devices 46 and has a minimum protrusion distance therefrom. Further, by keeping the amount of protrusion to a minimum, the amount of space required by the electronic devices 46 and their attendant AC power cords, beyond that which is occupied by the enclosures 47, is reduced to a minimum.

Thus, it will now be understood that there has been disclosed an AC power interconnect for stacked electronic devices that saves space and reduces the likelihood of accidents. While the invention has been particularly illustrated and described with reference to a preferred embodiment thereof, it will be understood by those skilled in the art that various changes in form, details, and applications may be made therein. It is accordingly intended that the appended claims shall cover all such changes in form, details and applications which do not depart from the true spirit and scope of the invention.

What is claimed as new and desired to be secured by Letters Patent of the United States is:

1. A device for electrically interconnecting two electronic devices, comprising:

a first connector for making electrical contact with a first of said electronic devices;

a second connector for making electrical contact with a second of said electronic devices stacked vertically with said first of said electronic devices; and a body member by which said first and second connectors are joined and having a conductor in said body member electrically connecting said first connector to said second connector, said body member and said first and second connections integrated into a single rigid structure;

said first and second connectors face in a common direction perpendicular to a longitudinal direction of said conductor to facilitate interconnection between said vertically stacked electronic devices;

wherein a distance between said first connector and said second connector is substantially equal to a distance between an AC input of said first electronic device and an AC output of said second electronic device, such that said device makes electrical connections for AC power therebetween with no surplusage to waste space.

2. The device according to claim 1, wherein said single rigid structure is shaped to have a minimal protrusion from said two electronic devices such that said single rigid structure will not catch on passing persons or objects.

3. An electrical device, comprising:

a male fitting having a plurality of female electrical connectors affixed therein;

a female receptacle having a plurality of male connectors affixed therein;

a body member perpendicularly attached at first end to said male fitting and at a second end to said female receptacle;

said body member having a plurality of conductors;

each of said plurality of conductors is electrically connected at a first end to one of said plurality of female connectors and at a second end to a corresponding one of said plurality of male connectors; and insulating material moldably enveloping said male fitting, said female receptacle, said connectors, said conductors, and said body member into a one piece electrical connector device.

4. The electrical device according to claim 3, wherein said male fitting and female receptacle face in a common direction.

5. The electrical device according to claim 4, wherein said common direction is substantially at a right angle to said body member.

6. The electrical device according to claim 5, wherein a distance between said male fitting and said female receptacle is substantially equal to a distance between an AC input of a stacked upper electronic device and an AC output of a lower electronic device, such that said electrical device electrically connects AC power therebetween with no surplus distance to waste space behind said electronic devices.

7. The electrical device according to claim 6, wherein said electrical device is sized and shaped such that it will not inadvertently catch on a passing object or person.

8. An electrical apparatus, comprising:

an IEC 320 male fitting having three female electrical connectors;

an IEC 320 female receptacle having three male electrical connectors;

three electrical conductors connected from each of said three female electrical connectors to a corresponding male connector of said three male electrical connectors; and rubber means for moldably enveloping n said IEC 320 male fitting, said female receptacle and said electrical conductors into a substantially rigid, one piece connector apparatus.

9. The electrical apparatus according to claim 8, wherein said IEC 320 male fitting and said IEC 320 female receptacle face are faced in a perpendicular direction from a longitudinal direction of said three conductors.

10. The electrical apparatus according to claim 9, wherein said IEC 320 male fitting and said IEC 320 female receptacle face in the same direction to facilitate connection between two vertically stacked electronic devices.

11. The electrical apparatus according to claim 10, wherein a distance between said male fitting and said female receptacle is substantially equal to a distance between an AC input of a stacked upper electronic device and an AC output of a lower electronic device, such that said electrical apparatus makes electrical connections for AC power therebetween with no surplusage to waste space behind said two vertically stacked electronic devices.

12. The electrical apparatus according to claim 11, wherein said substantially rigid, one piece connector is shaped to have a minimal protrusion from said two vertically stacked electronic devices such that said electrical apparatus will not catch on passing persons or objects.

13. A device for electrically interconnecting two electronic devices, comprising:

a first connector for making electrical contact with a first of said electronic devices;

a second connector for making electrical contact with a second of said electronic devices located adjacent to said first electronic device; and a body member by which said first and second connectors are joined and having a conductor in said body member electrically connecting said first connector to said second connector, said body member and said first and second connections integrated into a single rigid structure;

said first and second connectors face in a common direction that is perpendicular to a longitudinal direction of said conductor to facilitate interconnection between said two electronic devices; and wherein a distance between said first connector and said second connector is substantially equal to a distance between an AC input of said first electronic device and an AC output of said second electronic device, such that said device makes electrical connections for AC power therebetween with no surplusage to waste space.

14. The device according to claim 13, wherein said single rigid structure is shaped to have a minimal protrusion from said two electronic devices such that said single rigid structure will not catch on passing persons or objects.

* * * * *